US006298204B1

(12) United States Patent
Bertram et al.

(10) Patent No.: US 6,298,204 B1
(45) Date of Patent: Oct. 2, 2001

(54) CORONA CHARGER WITH INTEGRAL LATCH MEMBER FOR LOCATING THE CHARGER RELATIVE TO A ROLLER

(75) Inventors: Gary B. Bertram, Honeoye Falls; Carol K. Dunn, Rochester; Randall J. Taylor, Bergen, all of NY (US)

(73) Assignee: Nexpress Solutions LLC, Rochester, NY (US)

( * ) Notice: Subject to any disclaimer, the term of this patent is extended or adjusted under 35 U.S.C. 154(b) by 0 days.

(21) Appl. No.: 09/438,715

(22) Filed: Nov. 11, 1999

(51) Int. Cl.[7] ..... G03G 15/02; G03G 15/14

(52) U.S. Cl. ..... 399/170; 399/311; 250/324; 361/225

(58) Field of Search ..... 399/170, 171, 399/172, 311; 250/324, 325, 326; 361/225, 230

(56) References Cited

U.S. PATENT DOCUMENTS 4,442,356 4/1984 Ludwick et al. .
4,514,781 4/1985 Plasschaert et al. .
4,764,675 8/1988 Levy et al. .
5,324,941 6/1994 Gross et al. .
5,424,540 6/1995 Garcia et al. .
5,449,906 9/1995 Osbourne .
5,539,205 7/1996 Reale .
5,627,376 5/1997 Jaisinghani et al. .
5,672,871 9/1997 Jacobs et al. .

*Primary Examiner*—Richard Moses

(57) ABSTRACT

A corona charger and integral latch member device includes a corona charger having a longitudinally ending wall and a corona generating electrode extending generally parallel with the longitudinally extending wall and spaced a predetermined distance therefrom. A latch member has a portion integrally molded with the wall proximate one end of the charger to define part of a bearing surface for engaging a first axially directed member of a roller. The bearing surface is spaced from the wall so as to determine a location of the corona-generating electrode relative to the axially directed member.

10 Claims, 4 Drawing Sheets

CORONA CHARGER WITH INTEGRAL LATCH MEMBER FOR LOCATING THE CHARGER RELATIVE TO A ROLLER

CROSS REFERENCE TO RELATED APPLICATIONS

This application is related to commonly assigned U. S. application Ser. No. 09/438,160 filed on even date herewith in the names of Bertram et al and entitled CHARGER WIRE TENSIONING MOUNTING MECHANISM AND METHOD OF USING.

BACKGROUND OF THE INVENTION

The present invention relates generally to charging devices for use in electrostatographic devices and more particularly to corona-charging devices for use in such machines, which provide for accurate location of such devices.

Generally, the process of electrostatographic copying is executed by exposing a light image of an original document to a substantially uniformly charged photoreceptor member. Exposing the charged photoreceptor member to a light image selectively discharges the photoconductive surface thereof to create an electrostatic latent image of the original document on the photoreceptor member. The electrostatic latent image is subsequently developed into a visible image by a process in which charged developing material is deposited onto the photoconductive surface of the photoreceptor such that the developing material is selectively attracted to the image areas thereon. The developing material is then transferred from the photoreceptor member to a copy sheet on which the toner image may be permanently affixed to provide a reproduction of the original document. In a final step, the photoconductive surface of the photoreceptor member is cleaned to remove any residual developing material therefrom in preparation for successive imaging cycles.

The described process is well known and is useful for light lens copying from the original as well as the printing of documents from electronically generated or stored originals. Analogous processes also exist in other electrostatographic applications such as, for example, digital printing applications where latent images are generated by a modulated laser beam or LED printhead, or ionographic printing and reproduction processes in which charges are selectively deposited on a charge retentive surface in accordance with an image stored in electronic form.

In electrostatographic applications, it is common practice to use corona-generating devices for providing electrostatic fields to drive various machine operations. Such corona devices are primarily used to deposit charge on the photoreceptor member prior to exposure to the light image for subsequently enabling toner transfer thereto. In addition, corona devices are used in the transfer of an electrostatic toner image from a photoreceptor to a transfer substrate, in tacking and detacking paper to or from the imaging member by applying a neutralizing charge to the paper, and, generally in conditioning the imaging surface prior to, during and after toner is deposited thereon to improve the quality of the xerographic output copy.

In use, corona-generating wires are noted for the ability to produce reasonably uniform charge on a surface to be charged. However, in order to do so they are required to be positioned in accurate spacing from the surface to be charged. When positioned adjacent a roller, such as a transfer roller, the position of the photoconductive belt may be accurately controlled relative to the transfer roller. However, separate adjustment of the charger relative to the belt requires either expensive alignment structure for the charger or a service representative's time to accurately position the charger. It is an object of the invention to provide a device and method which facilitates accurate placement of the corona charger device.

SUMMARY OF THE INVENTION

These and other objects of the invention which will become more apparent after reading of the specification are realized by:

In accordance with one aspect of the invention there is provided a corona charger and integral latch member device for use in an electrostatographic recording apparatus comprising a corona charger having a longitudinally ending wall and a corona generating electrode extending generally parallel with the longitudinally extending wall and spaced a predetermined distance therefrom; and a latch member having a portion integrally molded with the wall proximate one end of the charger to define part of a bearing surface for engaging a first axially directed member of a roller, the bearing surface being spaced from the wall so as to determine a location of the corona generating electrode relative to the axially directed member.

In accordance with a second aspect of the intention there is provided a method of establishing a location of an electrode of a corona charger in an electrostatographic recording apparatus, the method comprising providing a corona charger having a longitudinally extending wall and a corona generating electrode extending generally parallel with the longitudinally extending wall and spaced a predetermined distance therefrom; and positioning an axially directed member of a roller against a bearing surface that is integrally molded to the wall to determine a location of the corona generating electrode relative to the axially directed member.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

Because apparatus of the general type described herein are well known the present description will be directed in particular to elements forming part of, or cooperating more directly with, the present invention.

Figure 12:
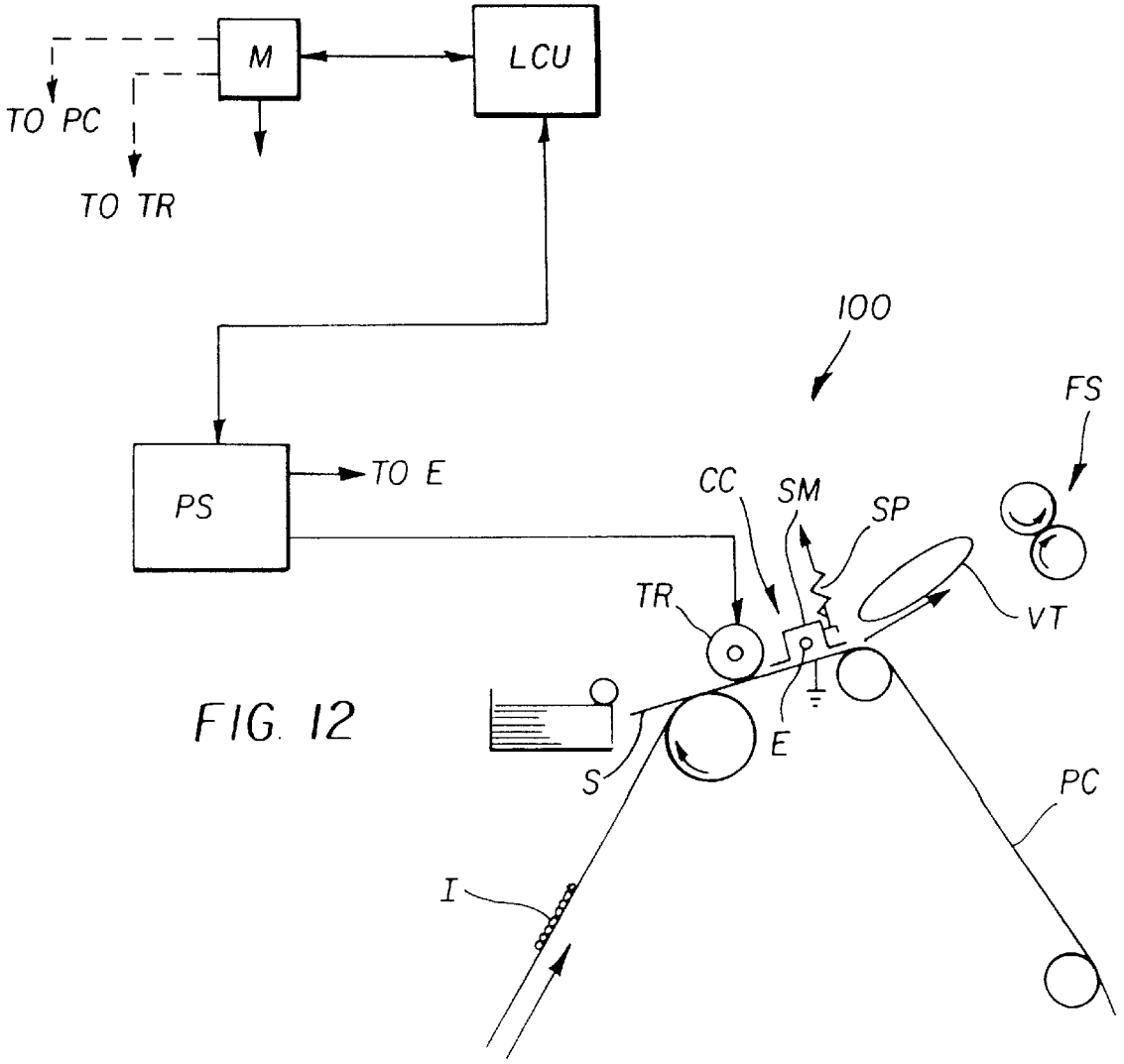
FIG. 12 a schematic side elevational view of the detack charger as positioned in an electrostatographic apparatus and illustrating its relative position in such apparatus.

With reference first to FIG. 12 there is shown a portion of an electrostatographic recording apparatus 100. The apparatus includes a primary image forming member PC which in the preferred embodiment is a photoconductive belt. The toner image, I, is formed on the belt by well known means and is to be transferred to a receiver sheet S. The toner image is advanced by movement of the belt in the direction indicated by having the belt trained about a series of rollers, one of which is driven. In lieu of a photoconductive belt, the image may be recorded using the electrographic recording on a dielectric web or belt member. In lieu of a belt or a web, a primary image may be formed on a photoconductive or electrographic recording drum. As a further alternative an intermediate transfer member may be provided and in such a case the detack roller and charger to be described may be used with such an intermediate transfer member.

In order to transfer the unfused toner image that is on the belt PC to a receiver sheet S, the receiver sheet S is fed into a nip formed between the belt and the transfer roller TR which is driven with the belt. A power supply PS is connected to the transfer roller to establish an electrical potential on the transfer roller for electrostatically transferring the toner image I to the receiver sheet S. The sheet S is detacked from the belt by depositing a charge of a suitable polarity to the backside of the receiver sheet as is well known. This latter charge is deposited by a detack corona charger CC which operates at an elevated electrical potential relative to a ground plane on the photoconductive belt to generate corona ions in the air which are attracted to the receiver sheet. The power to the corona charger may be from an AC power supply. As may be seen in FIG. 12, the corona charger CC includes an electrode E preferably in the form of a corona generating wire (coated or uncoated) although electrodes in the form of a strip with various points may also be used. In addition to the electrode the corona charger includes a shield member SM that is formed by a first set of walls which define an enclosure having an opening permitting corona charge to flow to the surface of the receiver sheet. A grating or grid may cover a portion of the opening. After the detacking charge is applied to the backside of the receiver sheet, the receiver sheet is removed from the belt such as by a vacuum transport device VT which conveys the sheet to a fusing station FS formed for example by a pair of heated rollers which apply heat and pressure to the sheet to fix the toner image to the sheet. The sheet is then transported to an output tray.

The control of timing of the various operations in the apparatus 100 is provided by a logic and control unit (LCU) which controls a motor M and power supplies PS and other components in response to receiving signals from various sensors. The LCU may comprise one or more microcomputers and attendant sensors and memory and programming as is well known.

Figure 1:
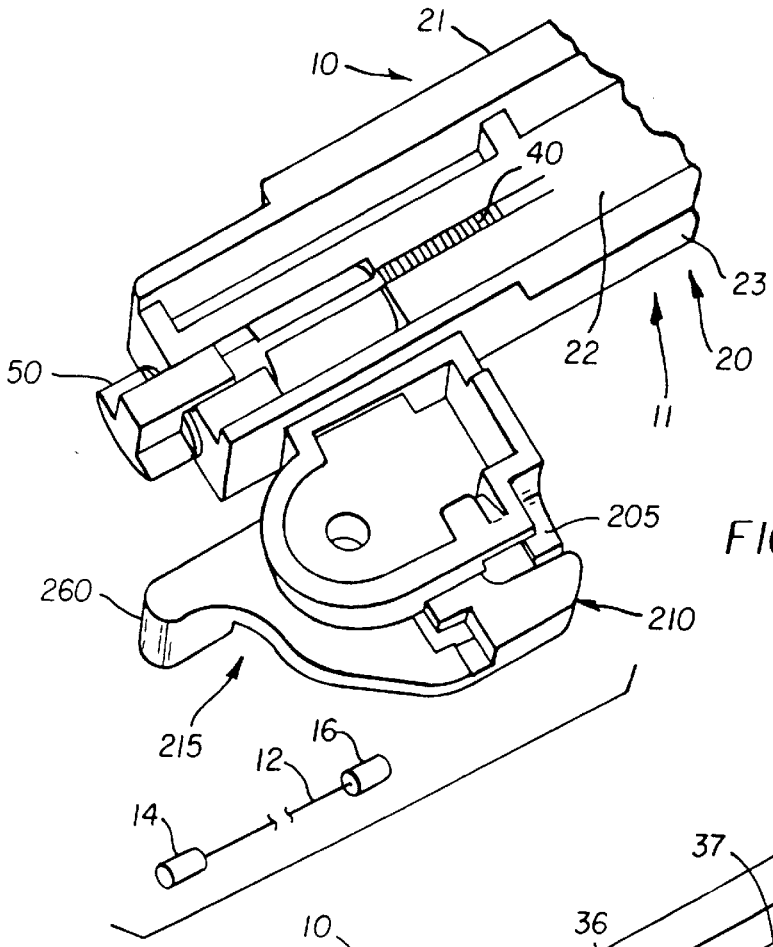
FIG. 1 is a prospective view of one end of a corona charger illustrating a latch device in accordance with the invention.
Figure 2:
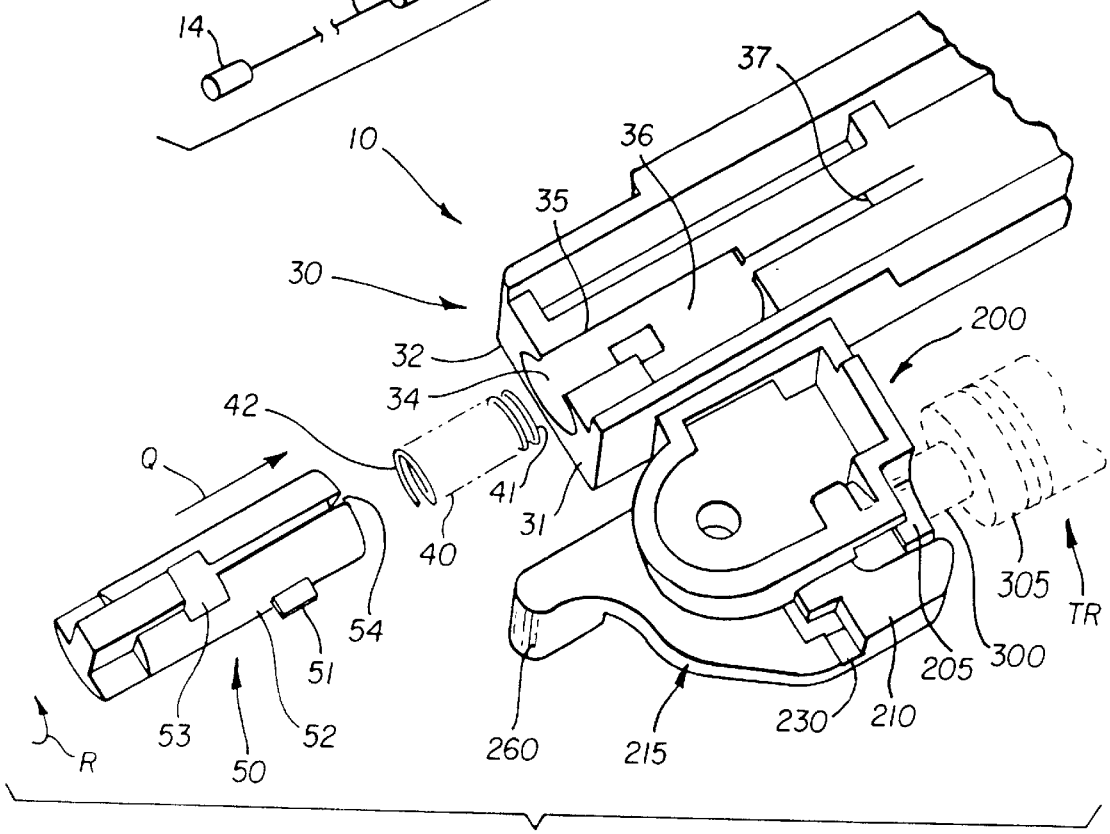
FIG. 2 is a view similar to that of FIG. 1 but representing an exploded view of various parts of the device of FIG. 1.

With reference now to FIGS. 1 and 2 an end portion of the corona charger CC is illustrated as corona charger 10. In order to provide for easy replacement of the corona generating electrode and tensioning of the electrode the corona charger 10 includes a first set of wall members 20 comprised of walls 21, 22, 23 which define a shield housing or member 11 for a corona generating electrode in the form of a wire 12. Other configurations of walls may be provided for defining a shield housing or member than that shown. The wire is of metal such as tungsten and of conventional form and includes a metal slug 14, 16 at each end which is preferably of copper but other electrically conductive metals or other materials may also be used for the slug. The slug is generally cylindrical but may also be shaped as a ball or other configuration, the important thing being it secures the wire which is embedded therein and has enough size to be trapped as will be described so as to secure the wire in tension and to transfer to the wire an electrical potential applied to the slug.

The corona charger shield member 11 is longitudinally extending so as to be of sufficient length to extend at least to substantially the fill width of the photoconductive web in a direction perpendicular to the direction of movement of the web PC.

At the end shown in FIGS. 1 and 2 and with reference also to FIGS. 4, 6, 10 and 11 the shield member includes a second set of wall members 30 formed of walls 31–35 for receiving a plunger member. The walls define a partially cylindrical bore opening 36 or recess for receiving a plunger member 50 and a coil spring 40 of suitable resiliency to provide the required tension but yet allows sufficient compression by an operator to permit for capture of the second end of the wire as will be described below.

The following describes how a repair person may position a new corona wire into the shield member. It is assumed that the charger 10 is removed from the apparatus 100 and the old electrode wire is removed.

The coil spring 40 is manually placed in the recess 36 of the shield member so that a head end 41 of the coil spring abuts or is trapped against an inner positioned land 37 of the recess which restricts further inward movement of the head end of the spring within the recess.

After insertion of the spring, the plunger member 50 is then manually moved into the recess. Initially the plunger member is manually rotated 90 degrees in the direction of the arrow R from that orientation shown in FIG. 2 to position a key 51 or projection so that the key faces upwardly. The plunger member includes a generally cylindrical sidewall 52 and the key extends radially from this sidewall. The key is oriented in this position so that the plunger member may be moved in the direction of the arrow Q and inserted in the recess without blockage by walls defining the cylindrical bore opening. In this regard walls 33, 35 of the recess define a key entry slot allowing the key to be moved into the recess while the key is between the walls 33, 35. Once advanced partially within the recess or cylindrical bore and when the key is advanced past wall 38 the plunger member is manually rotated back 90 degrees in the opposite direction, to obtain the orientation shown in FIGS. 1 and 2. After such back rotation, the plunger member 50 having engaged a tail end 42 of the coil spring and compressed the coil spring, now is urged by the coil spring so as to force the key against the terminus wall 38 of a key slot 39 which is a temporary keeper wall. With the trapping of the key against the temporary keeper wall 38 the plunger member is locked within the recess.

The plunger member is now in a proper orientation to permit insertion of one end of the corona generating electrode wire. The slug 14 at this end is inserted into a slug receiving opening 53 in the hollow plunger member. A slot 54 in the plunger member outer wall extends from the slug receiving opening towards the head end of the plunger for supporting of the one wire in the plunger member so that the wire end is supported above the spring.

Figures 4, 5, 6, 7, 8, 9:
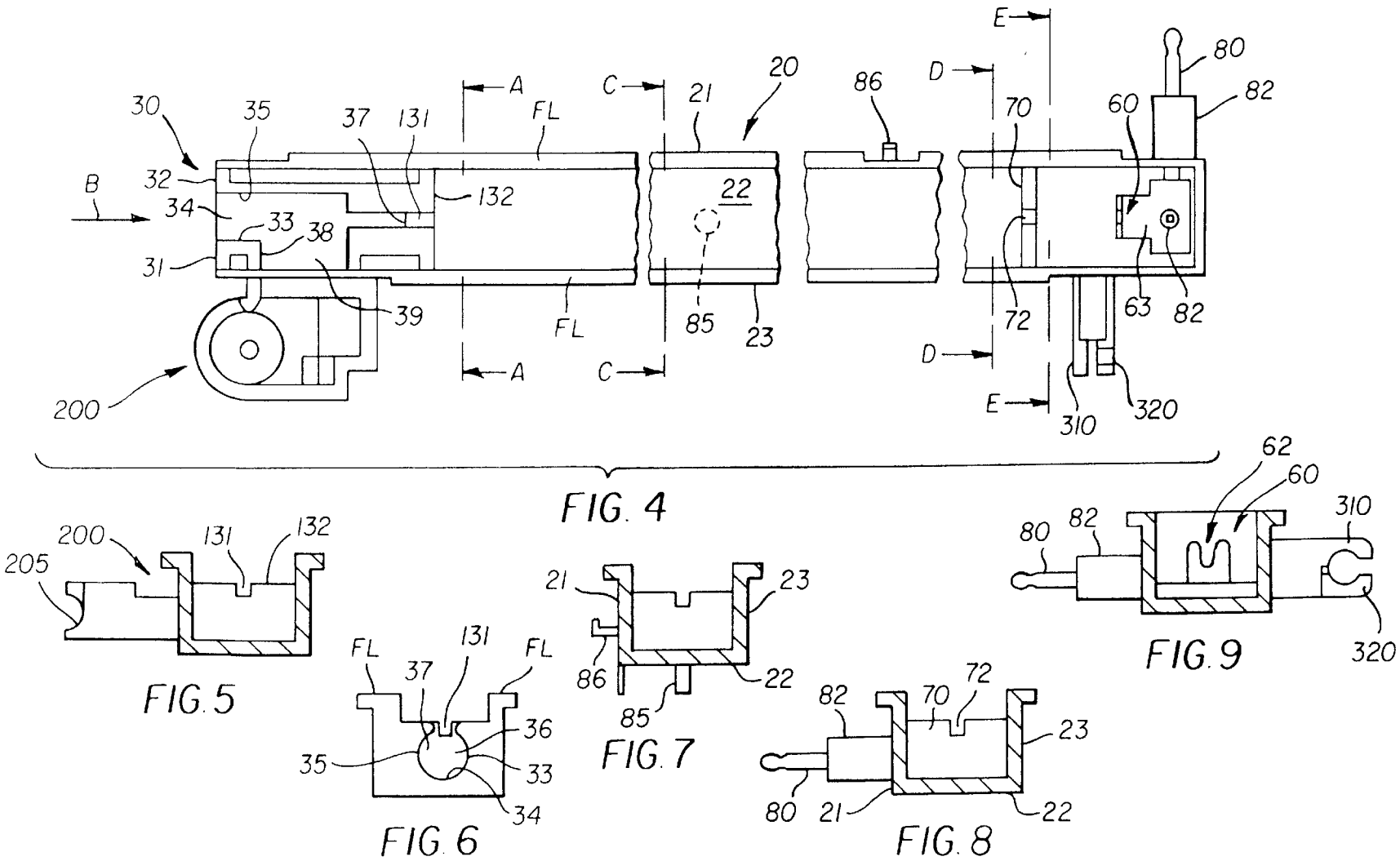
FIG. 4 is a plan view of a corona charger shield member partially illustrated in FIG. 1 and viewed head on towards the hollow into which the electrode wire is to be mounted, the wire being shown dash-dotted in the figure.
FIG. 5 is a sectional view of the shield member taken along a sectional line A—A. of FIG. 4.
FIG. 6 is an elevational view of the shield member taken from the viewpoint indicated by arrow B in FIG. 4.
FIG. 7 is a sectional view of the shield member taken along a sectional line C—C in FIG. 4.
FIG. 8 is a sectional view of the shield member taken along a sectional line D—D in FIG. 4.
FIG. 9 is a sectional view of the shield member taken along a sectional line E—E of FIG. 4.
Figure 10:
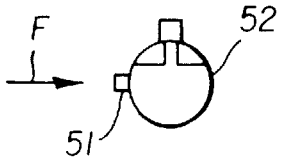
FIG. 10 is an elevational view of a head end portion of a plunger member that forms part of the corona charger of FIG. 1.
Figure 11:
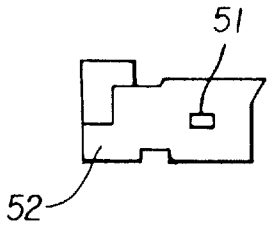
FIG. 11 is a side elevational view of the plunger member of FIG. 10 and taken from the viewpoint indicated by the arrow F in FIG. 10.

In order to connect a second end of the wire to an opposite end of the shield member the plunger member is manually pressed further into the recess to provide sufficient slack in the wire to allow the repair person to place the second end of the wire into a keeper 60 located at that end so that the slug 16 at that end of the wire is behind the keeper and is restrained by the keeper when the wire is under tension. The keeper as is illustrated in FIG. 9 need only be a pair of upstanding ears with a slot 62 between them of sufficient narrow spacing to block movement of the slug therethrough. As a less preferred alternative a hook may be formed on this end of the wire and attached in accordance with well-known attachment or keeper means.

With the second end of the wire now positioned in or held or restrained by keeper 60, the repair person releases pressure on the plunger member and the plunger member advances leftwardly in FIG. 4 under urging of the spring and away from the spring 40 until tension in the wire is established. The plunger member is free to translate in this direction as the key is now free to translate within the key slot 39.

The electrode wire is now in position within the shield member under suitable tension imposed by the spring. A bridge wall 70 is provided near the keeper 60 and includes a notch 72 into which the corona wire is located. The bottom of the notch, which engages the wire serves to locate the second end of the wire at one position while a slot 131 extending between the walls 37 and 132, serves to locate the wire at the plunger member receiving recess end of the shield member so that the substantial length of the electrode wire between the walls 132 and 70, and which is used for corona charging in the apparatus is substantially parallel to the shield member walls 21, 22, 23 and midway between shield member sidewalls 21 and 23.

The shield member may now be mounted in the electrostatographic apparatus 100. A metal power plug 80 is insert molded into the shield member for attachment to a power supply. An electrically conductive lug 63 is formed integral with the keeper 60, and a screw 82 passes through the lug and is threaded into a threaded opening in the power plug 80 to provide electrical connection of the keeper 60 to the plug 80 and to connect the keeper 60 to the shield member. The keeper 60 is also preferably made of phosphor bronze or other electrically conductive metal and is in electrical contact with the slug 16. The slug 16, of course, is electrically connected to the corona generating electrode wire by one end of the wire being embedded in the slug. The power plug includes an insulating sleeve 82 about a portion thereof A projection 85 is integrally molded to the outside of the shield member wall 22 to locate the shield member against a locating wall on the transfer roller assembly frame (not shown). The projection 85 is urged against the locating wall by a spring force established by spring SP (FIG. 12) which has one end attached to a hook projection 86 formed on wall 21 and a second end attached to the transfer roller assembly frame and biases the shield member upwardly. A surface of the shield member to which the hook projection is formed may be coated with the conductive paint. The spring is connected at its other end to a grounded member and thus provides a ground connection of the electrically conductive painted hook. Additionally, flanges FL are integrally molded on sidewalls 21, 23 to support a paper guide and grating assembly (not shown), if needed, that would in effect, extend the flange that is closer to the vacuum transport to reduce tendency of the paper from entangling in the shield member. The paper guide may have at its downstream end near the vacuum transport a static discharge brush.

It is desirable to accurately locate the transfer roller and corona charger electrode relative to the surface being charged. Where the transfer roller is accurately positioned relative to the surface being charged improved locating of the detack corona charger may be provided by mounting the detack corona charger using references associated with the transfer roller. The transfer roller assembly is disclosed in U.S. application Ser. No. 09/223,499 filed Dec. 30, 1998 in the names of Bertram et al.

The shield member is formed integral in a precision mold using a suitable plastic such as polysulfone blended with 30 percent glass fibers which is substantially electrically insulative. The electrical power plug 80 is insert molded in the shield member, and the metal keeper 60 is assembled to an exposed area of the power plug inside the shield member.

Figure 3:
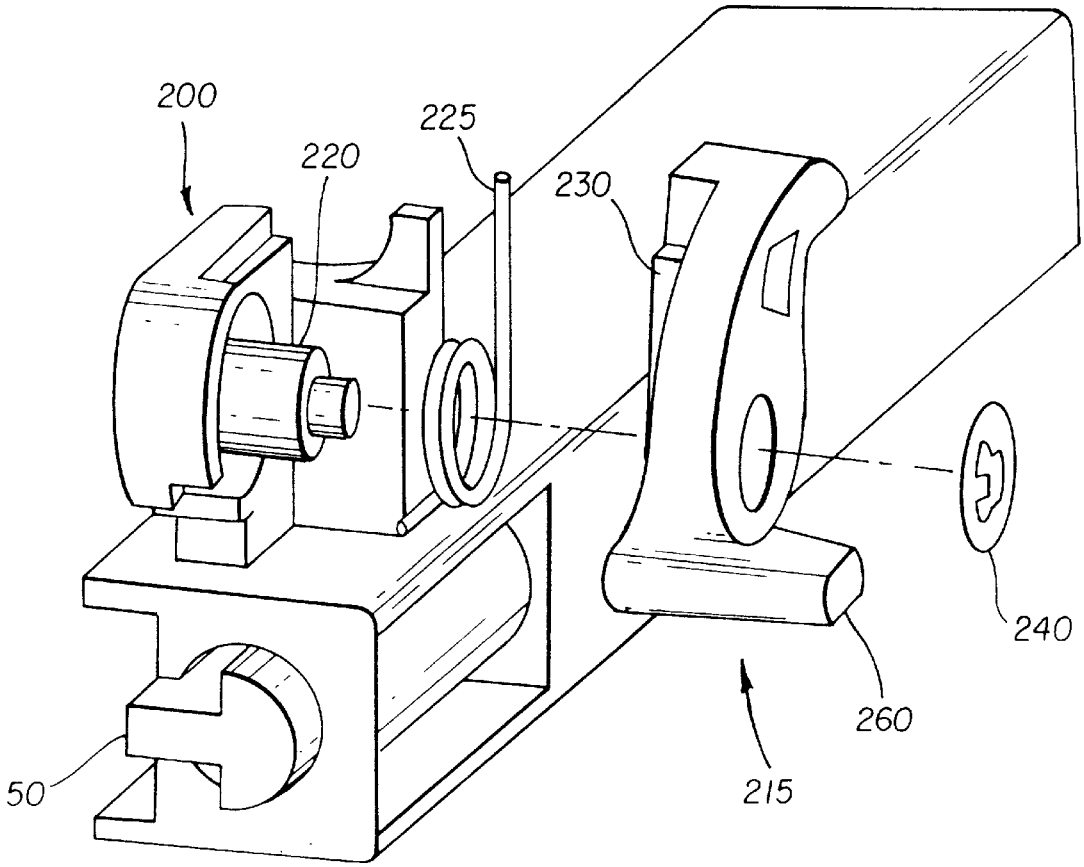
FIG. 3 is a different exploded prospective view of the latch device of FIG. 1.

With reference now additionally to FIGS. 2 and 3 in order to insure precise locating of the detack corona charger there is integrally molded to the corona charger's shield member sidewall 23 a bearing molded part 200 having a bearing surface 205 for engaging or contacting an axial extension member 300 of an end cap 305 that supports the transfer roller TR. By integrally molding the shield member and this bearing molded part 200 having the bearing surface 205 as one piece of the same polymeric plastic a precise relationship and spacing is established between the sidewall 23 (from which the bearing surface 205 extends) and the bearing surface 205. Because the slot 131 and notch 72 which locate the electrode wire in the shield member are also precisely controlled and spaced from the shield member sidewall 23 there is thus established a precise location of the electrode wire, when it is mounted into the shield member, relative to the transfer roller, when its end cap with the transfer roller affixed thereto is engaged with the bearing wall or surface 205.

With reference to FIGS. 1, 2, 3 and 5, there is illustrated the rounded bearing wall 205 formed on the shield member which can in broad terms be said to engage one end of the transport roller and more specifically to engage an axial extension of a nonrotating end cap into which an axle of the transfer roller is supported for rotation in a bearing forming a part of the end cap. This end of the roller is kept engaged by the bearing wall 205 by a spring biased finger 210 that is pivotally mounted on the shield member. The finger is part of a pivoting finger assembly 215 which is mounted upon a depending hub 220 integrally molded on the bearing molded part. A torsion spring 225 is also positioned on the hub and has one end connected to a land integrally formed with the bearing molded part and a second end held against a land 230 formed on the pivoting finger assembly to bias the pivoting finger so that the finger is spring urged towards the bearing surface 205 to locate the bearing surface with reference to the axial extension of the end cap.

At the other end of the shield member there are integrally formed upper 310 and lower 320 curved bearing surfaces for supporting the second end of the shield member. Within these bearing surfaces an axial extension of an end cap holding the second end of the transfer roller is located. This thereby locates this second end of the shield member with the transfer roller by molding the bearing surfaces 310 and 320, which engage the axial extension of the end cap holding the second end of the transfer roller, at a fixed distance relative to the sidewall 23.

A ring connector 240 is secured on the hub and locks the pivoting finger arm assembly 215 and torsion spring onto the shield member but permits pivoting movement about the hub axis allowing placement of an axial extension of the transfer to roller end cap 305 in the bearing surface 205. In this regard a lever arm 260 on the pivoting finger assembly is engageable by the repair person for pivoting the finger away from the bearing surface 205. Upon releasing the lever arm 260 the pivoting finger assembly is spring biased towards the curved bearing surface 205 to retain and hold the axial extension of the first end cap of the transfer roller in precise position relative to the corona generating electrode wire.

In an operation of mounting the corona charger to the transfer roller assembly, the transfer roller assembly is first mounted to the machine frame so that the transfer roller is accurately positioned relative to the photoconductive belt. The second end of the corona charger, with the wire electrode assembled in the shield member, is then mounted to the axial extension of the second end cap by moving the upper and lower curved bearing surfaces 310, 320 onto the axial extension of the second end cap. Then the repair person engages the lever arm 260 to pivot the spring biased finger 210 away from the bearing surface 205 to allow the axial extension of the first end cap to be engaged with the bearing surface 205. Thereafter the repair person releases the lever arm to move the finger into engagement with the axial extension of the first end cap so that the corona charger is mounted on the transfer roller assembly in accurate position relative to the photoconductive belt.

Rotation of the transfer roller is through bearings provided in the end caps so that preferably no rotation is provided in the bearings on the shield member supporting the end caps.

The invention has been described in detail with particular reference to certain preferred embodiments thereof, but it will be understood that variations and modifications can be effected within the spirit and scope of the invention.

What is claimed is:

1. A corona charger and integral latch member device for use in an electrostatographic recording apparatus comprising:

a corona charger having a longitudinally extending wall and a corona-generating electrode extending generally parallel with the longitudinally extending wall and spaced a predetermined distance therefrom; and a latch member having a portion integrally molded with the longitudinally extending wall proximate one end of the charger to define part of a bearing surface for engaging a first axially directed member of a roller, the bearing surface being spaced from the longitudinally extending wall so as to determine a location of the corona-generating electrode relative to the axially directed member.

2. The device of claim 1 and including a pivotable latch finger assembly forming a part of the latch member and a spring engaging the latch finger to bias the latch finger against the axially directed member.

3. The device of claim 2 and including a bearing member integrally molded proximate a second end of the charger for engaging a second axially directed member of the roller.

4. The device of claim 1 and including a bearing integrally molded proximate a second end of the charger for engaging a second axially directed member of the roller.

5. The device of claim 1 in combination with a transfer roller, and wherein the latch device supports the corona charger upon an axially directed member of the transfer roller.

6. A method of establishing a location of an electrode of a corona charger in an electrostatographic recording apparatus, the method comprising:

providing a corona charger having a longitudinally extending wall and a corona generating electrode extending generally parallel with the longitudinally extending wall and spaced a predetermined distance therefrom; and positioning an axially directed member of a roller against a bearing surface that is integrally molded to the wall to determine a location of the corona generating electrode relative to the axially directed member.

7. The method of claim 6 and pivoting a finger into engagement with the axially directed member to urge the axially directed member against the bearing surface.

8. The method of claim 7 and wherein the finger is pivoted into engagement with the axially directed member under the urging of a spring.

9. The method of claim 8 and including providing a second bearing integrally molded proximate a second end of the charger and engaging a second axially directed member of the roller in the second bearing.

10. The method of claim 6 and including providing a second bearing integrally molded proximate a second end of the charger and engaging the second axially directed member of the roller in the second bearing.

* * * * *